US005286943A

United States Patent [19]

Has

[11] Patent Number: 5,286,943

[45] Date of Patent: Feb. 15, 1994

[54] SENSOR-CONTROLLED OVEN PYROLYSIS UTILIZING FUZZY LOGIC CONTROL

[75] Inventor: Uwe Has, Schwindegg, Fed. Rep. of Germany

[73] Assignee: Bosch-Siemens Hausgeraete, Munich, Fed. Rep. of Germany

[21] Appl. No.: 932,304

[22] Filed: Aug. 19, 1992

[30] Foreign Application Priority Data

Aug. 19, 1991 [DE] Fed. Rep. of Germany ..... 4127389

[51] Int. Cl.[5] ..... F24C 14/02

[52] U.S. Cl. ..... 219/413; 134/1; 134/18; 126/273 R

[58] Field of Search ..... 219/413, 414, 509, 492; 134/18, 19, 1; 126/273 R, 19 R, 275 E; 99/451

[56] References Cited

U.S. PATENT DOCUMENTS

| | | | |
|---|---|---|---|
| 4,066,867 | 1/1978 | Bechtel | 219/483 |
| 4,481,404 | 11/1984 | Thomas et al. | 219/413 |
| 4,493,976 | 1/1985 | Wilson | 219/413 |
| 4,904,849 | 2/1990 | Sinn | 219/413 |
| 4,908,760 | 3/1990 | Sinn | 219/413 |
| 4,954,694 | 9/1990 | Nagai et al. | 219/413 |
| 5,083,010 | 1/1992 | Henry et al. | 219/413 |

FOREIGN PATENT DOCUMENTS

| | | |
|---|---|---|
| 441984 | 8/1991 | European Pat. Off. . |
| 64-75819 | 3/1989 | Japan . |
| 1-319619 | 12/1989 | Japan . |
| 2-166210 | 6/1990 | Japan . |
| 3-158198 | 7/1991 | Japan . |
| 4-284809 | 10/1992 | Japan . |

*Primary Examiner*—Bruce A. Reynolds
*Assistant Examiner*—John A. Jeffery

[57] ABSTRACT

A stove with pyrolytic self-cleaning includes an oven having at least one wall region and an outgoing air path. A heating element is disposed in the at least one wall region for operating the oven. A forced-air and/or convection blower vents the oven. A forced-air and/or convection heater is optionally provided for the oven. A device is provided for pyrolytically self-cleaning the oven. A gas sensor is disposed in the outgoing air path for issuing sensor signals. An evaluation unit for pyrolytic self-cleaning is connected to the gas sensor. The evaluation unit has a logic system adapted to a pyrolysis operation for analyzing the sensor signals. The evaluation unit uses the sensor signals after a typical pyrolysis operating time to determine a minimum pyrolysis temperature and an optimized total pyrolysis time being dictated by a type of soiling.

5 Claims, 2 Drawing Sheets

SENSOR-CONTROLLED OVEN PYROLYSIS UTILIZING FUZZY LOGIC CONTROL

Figure 1:
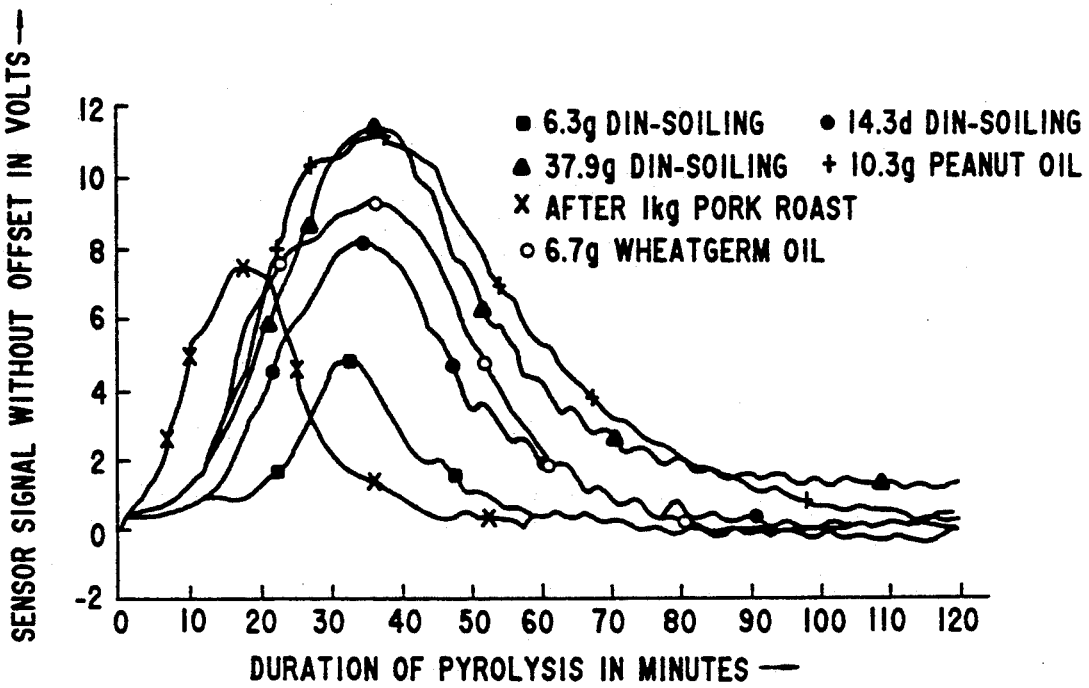

The invention relates to a stove with pyrolytic self-cleaning, having an oven which can be operated by a heating element disposed in at least one wall region and optionally with additional forced-air or convection air heating, the oven being able to be vented by a forced-air or convection air blower and being equipped with means for pyrolytic self-cleaning.

During roasting, cooking and baking, the insides of an oven are soiled in various ways. Such soiling substantially includes three components: spraying grease of animal or vegetable origin, residues from cooked food sticking to the oven walls, and condensation of vapor components on the oven walls.

During conventional pyrolytic self-cleaning of stoves in the way in which it has been performed heretofore, the oven walls are heated, while running through a specified time and temperature profile, to a temperature of 480° to 500° C. and are held for a certain period of time at high temperature. The time corresponds to an empirical value and does not represent the actual conditions of the oven soiling. The relatively long-chained molecules of the types of soiling sticking to the walls of the oven are subjected to a thermal cracking process by the long-lasting heating to above 450° C., and are thus converted into relatively short-chained decomposition products, such as water, short-chained hydrocarbons, aromatics, and ash residues. The gaseous products of decomposition are carried out of the stove with the ventilation during the self-cleaning. After the self-cleaning, the remaining residues can simply be removed from the stove in the form of ashes. During the pyrolytic self-cleaning, the stove is locked to avoid accidents, and it is released for use again only after the temperature has dropped below a specified temperature threshold.

It is accordingly an object of the invention to provide a stove with sensor-controlled pyrolysis, which overcomes the hereinafore-mentioned disadvantages of the heretofore-known devices of this general type and which carries out the pyrolytic self-cleaning operation as a function of the actual rate of soiling.

With the foregoing and other objects in view there is provided, in accordance with the invention, a stove with pyrolytic self-cleaning, comprising an oven having at least one wall region and an outgoing air path; a heating element disposed in the at least one wall region for operating the oven; a forced-air blower for venting the oven; an optional forced-air heater for the oven; means for pyrolytically self-cleaning the oven; a gas sensor disposed in the outgoing air path for issuing sensor signals; and an evaluation unit for pyrolytic self-cleaning being connected to the gas sensor, the evaluation unit having a logic system adapted to a pyrolysis operation for analyzing the sensor signals, and the evaluation unit using the sensor signals after a typical pyrolysis operating time to determine a minimum pyrolysis temperature and an optimized total pyrolysis time being dictated by a type of soiling.

In accordance with another feature of the invention, the gas sensor reacts with an evaluatable change in electrical resistance to short-chained hydrocarbons and hydrogen molecules.

In accordance with a further feature of the invention, the logic system of the evaluation unit is a partial fuzzy logic system for predetermining a necessary total pyrolysis time as a function of a degree of soiling, then correcting with reference to the sensor signals, and turning off the heating elements after the times have elapsed.

In accordance with an added feature of the invention, the evaluation unit terminates ventilating of the oven with the forced-air blower after terminating a heat output from the heating element.

In accordance with a concomitant feature of the invention, for expected peak oven temperatures higher than 470° C., the evaluation unit increases a sampling frequency of the sensor signal before an occurrence of a temperature rise above 470° C.

Other features which are considered as characteristic for the invention are set forth in the appended claims.

Although the invention is illustrated and described herein as embodied in a stove with sensor-controlled pyrolysis, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
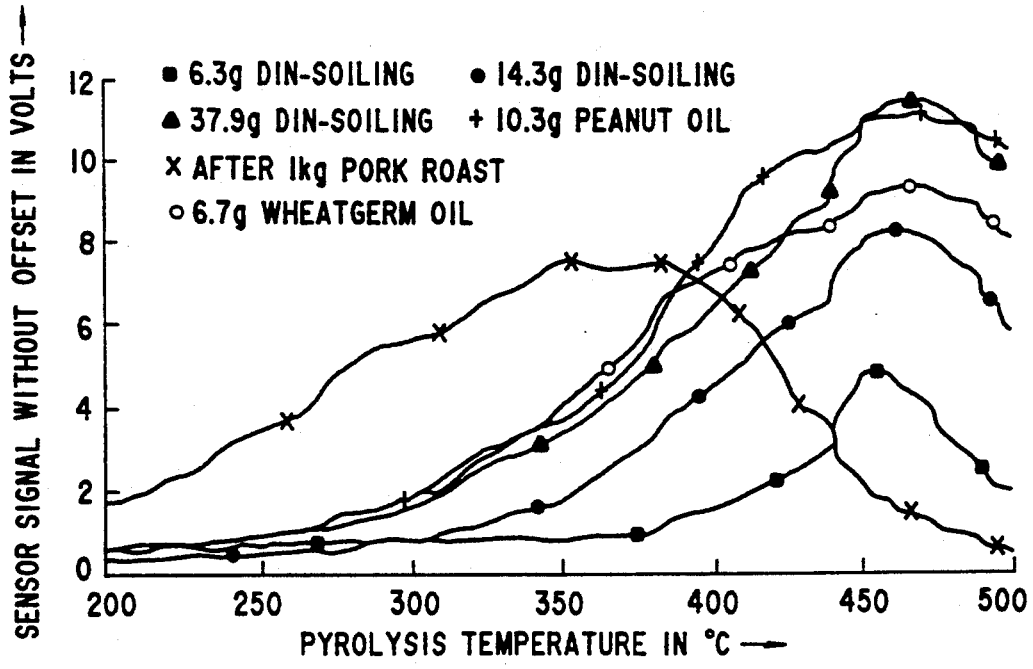
Figure 3:
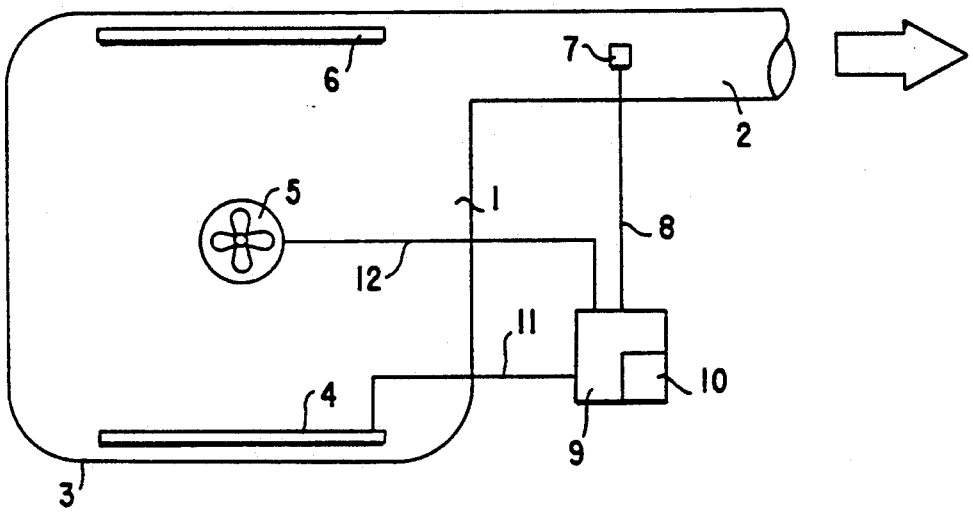

FIG. 1 is a graph showing a sensor signal course during a pyrolysis time with various kinds of soiling; and FIG. 2 is a graph showing sensor signals during a rise in the pyrolysis temperature for various kinds of soiling; and FIG. 3 is a fragmentary, diagrammatic, side-elevational view of an oven of a stove of the invention, with a side of the oven removed.

Referring now to the figures of the drawing in detail and first, particularly, to FIG. 3 thereof, there is seen an oven 1 of a stove with pyrolytic self-cleaning. The oven 1 has at least one wall region 3 and an outgoing air path 2. A heating element 4 is disposed in the at least one wall region 3 for operating the oven 1. A forced-air or convection blower and/or heater 5 is provided for venting and/or heating the oven. Means 6 are provided for pyrolytically self-cleaning the oven 1. A gas sensor 7 is disposed in the outgoing air path 2 for issuing sensor signals over a line 8. The gas sensor 7 reacts with an evaluatable change in electrical resistance to short-chained hydrocarbons and hydrogen molecules. An evaluation unit 9 for pyrolytic self-cleaning is connected to the gas sensor 7 by the line 8. The evaluation unit 9 has a logic system 10 adapted to a pyrolysis operation for analyzing the sensor signals. The evaluation unit uses the sensor signals after a typical pyrolysis operating time to determine a minimum pyrolysis temperature and an optimized total pyrolysis time being dictated by a type of soiling.

The logic system 10 of the evaluation unit 9 is a partial fuzzy logic system for predetermining a necessary total pyrolysis time as a function of a degree of soiling, then correcting with reference to the sensor signals, and turning off the heating element over a line 11 after the times have elapsed.

The evaluation unit 9 terminates venting of the oven with the forced-air blower over a line 12 after terminating a heat output from the heating element. For expected peak oven temperatures higher than 470° C., the evaluation unit increases a sampling frequency of the sensor signal before an occurrence of a temperature rise above 470° C.

FIGS. 1 and 2 show diagrams that illustrate various soiling values with associated sensor signal courses in a parametric association.

FIG. 1 illustrates a family of curves which show the course of the sensor signal over the pyrolysis time for various soiling rates as parameters. These curves can only be qualitatively interpreted, because constantly changing conditions, such as fluctuations in the mains voltage, other types of soiling in the oven space, the size of the oven space, the type of heating of the oven space, and so forth can have a considerable effect on quantitative curve courses. In the case of the controlled pyrolysis operation it is therefore absolutely necessary for an evaluation unit equipped with fuzzy logic to initiate the various control steps needed by constant sampling of the sensor signals. However, it can be seen from FIG. I that identical types of soiling reach their maximums virtually simultaneously after a certain pyrolysis duration. It can be assumed that heating times longer than one hour will not be necessary when the necessary pyrolysis temperature is reached, that is the temperature which has an adequate cracking force for the degree of soiling. On one hand, this depends on the extent to which the soiling includes complicated compositions, with respect to animal and vegetable fats, sticky baked food residues and complicated products of condensation of vapor components and on the initial temperature at which the pyrolysis is started.

Of course, for a pyrolytic self-cleaning process, it is also possible that a plurality of curves with different maximums must be run through until an unequivocal sensor signal development that matches the pyrolysis duration and approaches asymptotic zero is apparent. It is therefore necessary for the evaluation unit to analyze the sensor signals with a logic system adapted to the pyrolysis mode, which is suitably a combination of sharp and fuzzy logic, and for the evaluation unit to determine a minimum pyrolysis temperature from the sensor signals after a typical pyrolysis operation time. The sensor signals are shown in FIG. 2 with respect to the temperature course. It can be seen that the maxima of the sensor signals occur at temperatures which are typical cleaning temperatures for the applicable soiling in the oven space. Generally, pyrolytic self-cleaning temperatures above 470° C. will be necessary. However, it can still be seen from the family of curves in FIG. 2, that not every kind of soiling requires this temperature. In this respect it is also true, as noted for FIG. 1, that a fuzzy logic for the evaluation unit is advantageous in order to ascertain an optimal pyrolysis temperature, as referred to the particular type of soiling in the oven space. By using suitable sensor technology in the outgoing air conduit of the oven of the stove, statements can be made regarding the following points, relating to the pyrolysis:

Level of the necessary pyrolysis temperature.

Indication of the necessary pyrolysis duration.

Specifications for ventilating and venting the oven box.

Indications as to the quantity and velocity of the forced air.

Possible detection of foreign objects accidentally present in the roasting and baking pipe.

As compared with the procedures heretofore used in pyrolytic self-cleaning, in which a rigid time and temperature profile was run through, or in other words in which the stove was operated at high temperature for a certain empirically ascertained period of time, the sensor-controlled pyrolysis has the following advantages:

Energy consumption is reduced sharply, since it is only very seldom that the existing soiling reaches the maximum value for which the time and temperature profile was previously configured.

The stove is under much less strain, and as a result the service life of the enamel of the oven is lengthened.

The danger of fire in the case of errors in operation is reduced, because the sensor system analyzes unsuitable items inserted in the oven space.

It is possible to minimize noise production.

These detection capabilities and advantages of sensor-controlled pyrolysis, combined with an evaluation unit that uses both sharp and fuzzy logic in a problem-oriented way, improve the convenience of the stoves equipped with it in a suitably manner.

I claim:

1. A stove with pyrolytic self-cleaning, comprising:

an oven having at least one wall region and an outgoing air path;

a heating element disposed in said at least one wall region for operating said oven;

a forced-air blower for venting said oven;

means for pyrolytically self-cleaning said oven;

a gas sensor disposed in said outgoing air path for issuing sensor signals;

an evaluation unit for pyrolytic self-cleaning being connected to said gas sensor, said evaluation unit having a logic system adapted to a pyrolysis operation for analyzing the sensor signals, and said evaluation unit using the sensor signals after a typical pyrolysis operating time to determine a minimum pyrolysis temperature and an optimized total pyrolysis time being dictated by a type of soiling; and wherein for expected peak oven temperatures higher than 470° C., said evaluation unit increases a sampling frequency of the sensor signals before a temperature raised above 470° C.

2. The stove with pyrolytic self-cleaning according to claim 1, including a forced-air heater for said oven.

3. The stove with pyrolytic self-cleaning according to claim 1, wherein said gas sensor reacts with an evaluatable change in electrical resistance to short-chained hydrocarbons and hydrogen molecules.

4. The stove with pyrolytic self-cleaning according to claim 1, wherein said logic system of said evaluation unit is a partial fuzzy logic system for predetermining a necessary total pyrolysis time as a function of a degree of soiling, then correcting with reference to the sensor signals, and turning off said heating element after the times have elapsed.

5. The stove with pyrolytic self-cleaning according to claim 4, wherein said evaluation unit terminates venting of said oven with said forced-air blower after terminating a heat output from said heating element.

* * * * *